US007967173B2

(12) United States Patent
Kopp et al.

(10) Patent No.: US 7,967,173 B2
(45) Date of Patent: Jun. 28, 2011

(54) DEVICE AND ASSOCIATED METHODS FOR STORING, DISPLAYING, AND SHAPING HATS

(76) Inventors: Kenneth B. Kopp, Greenville, SC (US); James T. Kopp, Sr., Easley, SC (US)

( * ) Notice: Subject to any disclaimer, the term of this patent is extended or adjusted under 35 U.S.C. 154(b) by 844 days.

(21) Appl. No.: 11/953,034

(22) Filed: Dec. 8, 2007

(65) Prior Publication Data

US 2009/0145935 A1 Jun. 11, 2009

(51) Int. Cl.
*A42C 1/04* (2006.01)

(52) U.S. Cl. ..... 223/14; 223/12

(58) Field of Classification Search ..... 223/12, 223/14, 85, 88, 89

See application file for complete search history.

(56) References Cited

U.S. PATENT DOCUMENTS

| | | | | | |
|---|---|---|---|---|---|
| D167,986 | S | * | 10/1952 | Jonaitis | D6/315 |
| 3,161,293 | A | * | 12/1964 | Sander | 211/33 |
| 4,778,088 | A | * | 10/1988 | Miller | 223/91 |
| 4,927,063 | A | | 5/1990 | Fricano | |
| 5,137,157 | A | | 8/1992 | Lawson | |
| 5,148,954 | A | | 9/1992 | Myers | |
| 5,244,102 | A | | 9/1993 | Koenig | |
| 5,630,516 | A | | 5/1997 | Helman | |
| 5,685,465 | A | | 11/1997 | Berardis | |
| 5,727,694 | A | | 3/1998 | Larson | |
| D393,970 | S | | 5/1998 | Lee | |
| D441,174 | S | | 5/2001 | Farbenbloom | |
| 6,273,274 | B1 | | 8/2001 | Lyles | |
| 6,311,879 | B1 | | 11/2001 | Rigler et al. | |
| 6,422,400 | B1 | | 7/2002 | Miller | |
| 6,422,401 | B1 | | 7/2002 | Roten | |
| 6,824,027 | B2 | | 11/2004 | Frey | |
| 6,840,411 | B2 | | 1/2005 | Fritz | |
| 7,097,080 | B2 | | 8/2006 | Cox | |
| 2009/0145935 | A1 * | | 6/2009 | Kopp et al. | 223/14 |
| 2009/0146036 | A1 * | | 6/2009 | Kopp et al. | 248/342 |

* cited by examiner

*Primary Examiner* — Shaun R Hurley
*Assistant Examiner* — Andrew W Sutton
(74) *Attorney, Agent, or Firm* — Crose Law LLC; Bradley D. Crose

(57) ABSTRACT

The technology described herein provides a device and associated methods for storing, displaying, and shaping hats, caps, or the like. This device includes multiple rings of the same diameter and multiple rings of varied diameters to provide for the storing and displaying of a multiplicity of hats while simultaneously maintaining the curvature of the brim portion of the hat. This device provides for the training of the brim of a hat to a particular degree of curvature as desired by the wearer and as selected from the multiple rings of varied diameters of the device. Other comparable uses are also contemplated herein, as will be apparent to those of ordinary skill in the art.

18 Claims, 4 Drawing Sheets

DEVICE AND ASSOCIATED METHODS FOR STORING, DISPLAYING, AND SHAPING HATS

FIELD OF THE INVENTION

The technology described herein relates generally to devices and methods for storing, displaying, and shaping hats, caps, or the like. More specifically, this technology relates to a device for storing and displaying a multiplicity of hats while simultaneously maintaining the curvature of the brim portion of the hat. Additionally, this technology relates to a device for training the brim of a hat to a particular degree of curvature as desired by the wearer and as selected in the device.

BACKGROUND OF THE INVENTION

Hats and caps of various styles, sizes, colors, materials, advertising, endorsements, etc. are becoming increasingly popular and are used in a variety of sporting and leisure pursuits. One very well-liked hat, for example, is the baseball cap. For owners of many baseball caps, much time is spent locating a particular hat from the owner's collection when no device exists for the display, access, and storage of a multiplicity of hats. Additional time is spent by the owner of a baseball cap manually working with the brim of the cap to reach a desired shape or curvature of the brim. It is desired to have a device and associated methods for simultaneously storing, displaying, and shaping a multiplicity of hats.

Hat storage and display devices are well known in the art. However, there are many deficiencies with these known devices. Many such devices do not hold a multiplicity of hats while simultaneously providing for the display of each hat and simultaneously providing brim maintenance to the curvature of the brim of each hat. Other known hat storage and display devices do not provide the means to train or maintain the curvature of the brim of each hat after initial training.

The following utility patents and design patents are known in the art. U.S. Pat. No. 6,840,411, issued to Fritz, discloses a storage and display device for baseball-type caps. U.S. Pat. No. 6,422,401, issued to Roten, discloses a hat storage and fashioning rack. U.S. Pat. No. 6,422,400, issued to Miller, discloses a brimmed cap storage and display device. U.S. Pat. No. 6,311,879, issued to Rigler et al., discloses a cap storage and bill shape maintenance device. U.S. Pat. No. 6,824,027, issued to Frey, discloses a cap brim shaper. U.S. Pat. No. 7,097,080, issued to Cox, discloses an athletic headwear shaping device. U.S. Pat. No. 5,244,102, issued to Koenig, discloses a cap receiving apparatus. U.S. Pat. No. 5,685,465, issued to Berardis, discloses a device for shaping the brim of a baseball cap. U.S. Pat. No. 5,727,694, issued to Larson, discloses a hat holder. U.S. Pat. No. 5,137,157, issued to Lawson, discloses a cap holder. U.S. Pat. No. 5,630,516, issued to Helman, discloses a ball cap display and storage rack assembly. U.S. Pat. No. D393,970, issued to Lee, discloses the ornamental design for a door-mounted cap-rack. U.S. Pat. No. 4,927,063, issued to Fricano, discloses a combination hat hanger and visor press. U.S. Pat. No. 5,148,954, issued to Myers, discloses an adjustable cap shaper. U.S. Patent No. D441,174, issued to Farbenbloom, discloses the ornamental design for a hat shaper and sizer. U.S. Pat. No. 6,273,274, issued to Lyles, discloses a folded cap holder.

The foregoing patent information reflects the state of the art of which the inventor is aware and is tendered with a view toward discharging the inventor's acknowledged duty of candor in disclosing information that may be pertinent to the patentability of the technology described herein. It is respectfully stipulated, however, that the foregoing patents do not teach or render obvious, singly or when considered in combination, the inventor's claimed invention.

BRIEF SUMMARY OF THE INVENTION

In various exemplary embodiments, the technology described herein provides a device and associated methods for storing, displaying, and shaping hats, caps, or the like. Additionally, this technology provides a device for storing and displaying a multiplicity of hats while simultaneously maintaining the curvature of the brim portion of the hat. Furthermore, this technology provides a device for training the brim of a hat to a particular degree of curvature as desired by the wearer and as selected in the device. Other comparable uses are also contemplated herein, as will be apparent to those of ordinary skill in the art.

In one exemplary embodiment, the technology provides a cap storage, display, and shaper device for simultaneously storing, displaying, and shaping a multiplicity of caps in a manner wherein each cap is suspended by a brim of the cap. The device includes a first plurality of rings, substantially similar in diameter and hung in a suspended manner, each of the first plurality of rings being flexibly connected to an at least one other ring of the first plurality of rings and each ring of the first plurality of rings configured to receive a cap by a brim of the cap in a suspended manner and to maintain the degree of curvature of the brim of the cap.

The device also includes a second plurality of rings, substantially dissimilar in diameter and hung in a suspended manner, each of the second plurality of rings being flexibly connected to an at least one other ring of the second plurality of rings, and an at least one of the second plurality of rings being connected to an at least one of the first plurality of rings, and each ring of the second plurality of rings configured to receive a cap by a brim of the cap to train the brim of the cap to a predetermined degree of curvature based on which of the second plurality of rings is selected. The device also includes a plurality of ring connectors, each ring connector configured to connect a pair of rings from the first plurality of rings, the second plurality of rings, or a combination of a ring from the first plurality of rings and a ring from the second plurality of rings.

The device also includes a support rod, placed atop the cap storage, display, and shaper device in a substantially horizontal manner, from which to suspend the first plurality of rings and the second plurality of rings and to provide structural integrity to the cap storage, display, and shaper device and a hook, located in a substantially central manner on top of the support rod, and from which the cap storage, display, and shaper device is hung.

The device also includes a plurality of user options in the cap storage, display, and shaper device from wherein a user selects a degree of curvature desired for the brim of the cap based on the diameter of one of the second plurality of rings and wherein the user subsequently selects one of the second plurality of rings into which to place a cap and to suspend by a brim of the cap to train the brim to the degree of curvature desired.

The first plurality of rings and the second plurality of rings of the cap storage, display, and shaper device are collapsible, thus configured to provide compactability and portability. The first plurality of rings, substantially similar in diameter, forms a grid of rows and columns to simultaneously store, display, and shape a plurality of caps. A crown portion of each of one or more caps stored in one of the first plurality of rings or the second plurality of rings is supported in the suspended manner of the cap, and is thus visible in display for selection. The device is configured to suspend also from a surface such as a door, wall, or the like.

Additionally, any ring of the first plurality of rings and the second plurality of rings is connected to any other ring of the first plurality of rings and the second plurality of rings with a fabric material that is wrapped around the rings to provide connectivity. Each of the first plurality of rings, substantially similar in diameter, is substantially circular to provide a round hole into which to place the brim of the cap. Each of the second plurality of rings, substantially dissimilar in diameter, is ovoid in shape to provide an oval hole into which to place the brim of the cap to train the brim to achieve a desired degree of curvature. An arrangement pattern of the first plurality of rings and the second plurality of rings is reconfigurable by the user to determine the overall shape of the cap storage, display, and shaper device.

In another exemplary embodiment, the technology provides a method for simultaneously storing, displaying, and shaping a multiplicity of caps in a manner wherein each cap is suspended by a brim of the cap. The method comprising includes utilizing the aforementioned cap storage, display, and shaper device and placing a brim of a cap into one of the first plurality of rings, where the cap will remain in a suspended manner while storing and displaying the cap and maintaining the degree of curvature of the brim of the cap is maintained.

The method also includes placing a brim of a cap into one of the second plurality of rings, where the cap will remain in a suspended manner while training the brim of the cap. The method also includes connecting any of the rings of the cap storage, display, and shaper device together with one or more of the plurality of rings connectors. The method also includes hanging the cap storage, display, and shaper device from the hook such that the first plurality of rings and the second plurality of rings are suspended from the support rod. The method also includes collapsing the cap storage, display, and shaper device for compactability and portability. The method also includes suspending the cap storage, display, and shaper device from a surface such as a door, wall, or the like.

In yet another exemplary embodiment, the technology provides a cap storage, display, and shaper device for simultaneously storing, displaying, and shaping a multiplicity of caps in a manner wherein each cap is suspended by a brim of the cap in a planar from a ring cut into a planar surface. This device includes a first plurality of rings, substantially similar in diameter and cut into a planar surface, each ring of the first plurality of rings configured to receive a cap by a brim of the cap in a suspended manner and to maintain the degree of curvature of the brim of the cap and a second plurality of rings, substantially dissimilar in diameter and cut into the planar surface, each ring of the second plurality of rings configured to receive a cap by a brim of the cap to train the brim of the cap to a predetermined degree of curvature based on which of the second plurality of rings is selected.

Advantageously, this technology provides a device for storing and displaying a multiplicity of hats while simultaneously maintaining the curvature of the brim portion of the hat. Additionally, this technology provides a device for training the brim of a hat to a particular degree of curvature as desired by the wearer and as selected in the device.

There has thus been outlined, rather broadly, the features of this technology in order that the detailed description that follows may be better understood, and in order that the present contribution to the art may be better appreciated. There are additional features of the invention that will be described and which will form the subject matter of the claims. Additional aspects and advantages of this technology will be apparent from the following detailed description of an exemplary embodiment which is illustrated in the accompanying drawings. The technology described is capable of other embodiments and of being practiced and carried out in various ways. Also, it is to be understood that the phraseology and terminology employed are for the purpose of description and should not be regarded as limiting.

BRIEF DESCRIPTION OF THE DRAWINGS

The technology described herein is illustrated with reference to the various drawings, in which like reference numbers denote like system components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a device and associated methods for storing, displaying, and shaping hats, caps, or the like. Additionally, this technology provides a device for storing and displaying a multiplicity of hats while simultaneously maintaining the curvature of the brim portion of the hat. Furthermore, this technology provides a device for training the brim of a hat to a particular degree of curvature as desired by the wearer and as selected in the device. Other comparable uses are also contemplated herein, as will be apparent to those of ordinary skill in the art.

Figure 1:
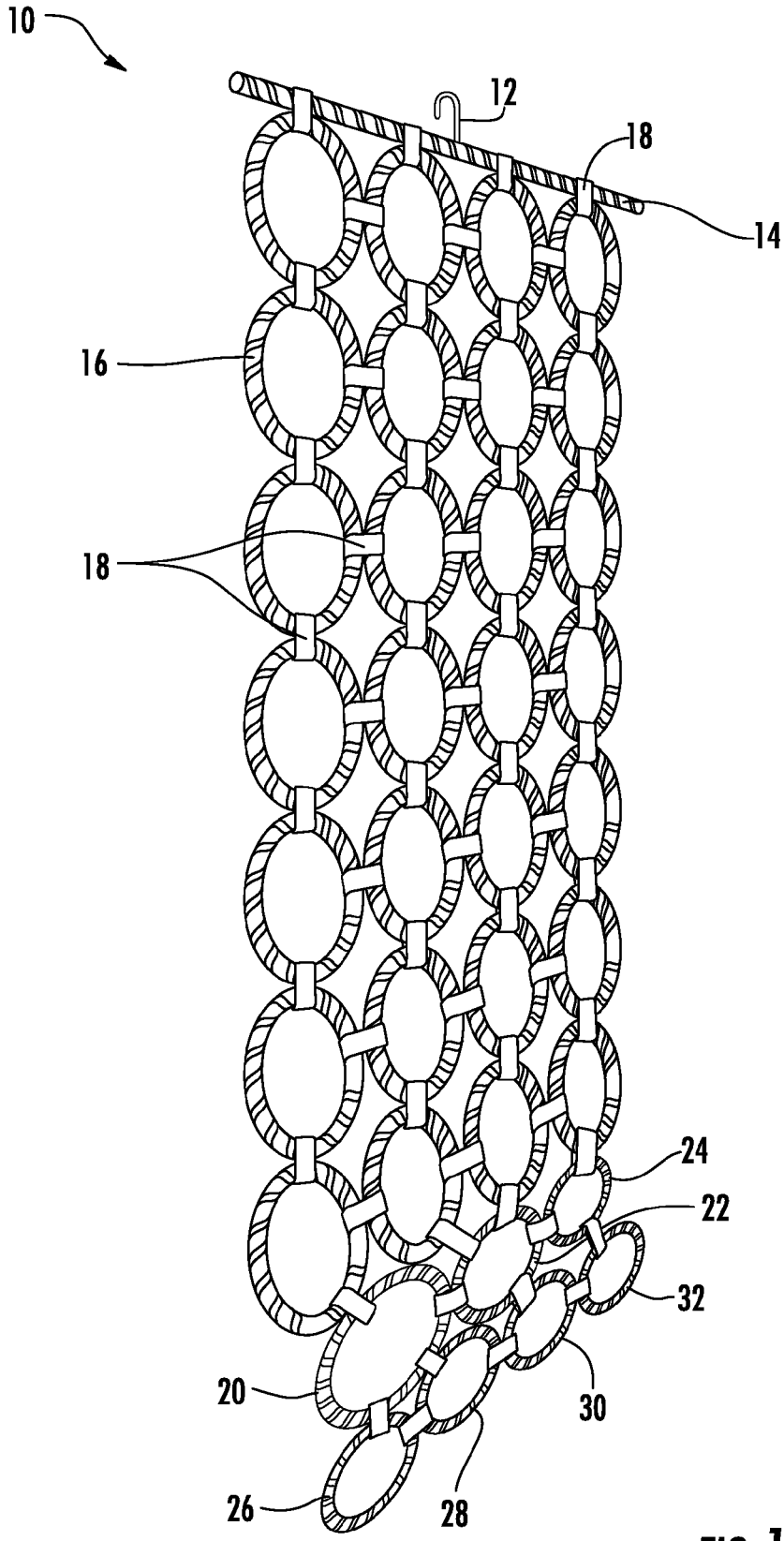
FIG. 1 is a front perspective view of a hat storing, displaying, and shaping device, according to one embodiment of the technology described herein, illustrating, in particular, a multiplicity of rings into which hats are to be placed for storing and displaying the hats and for shaping and maintaining the curvature of the brims of the hats.
Figure 2:
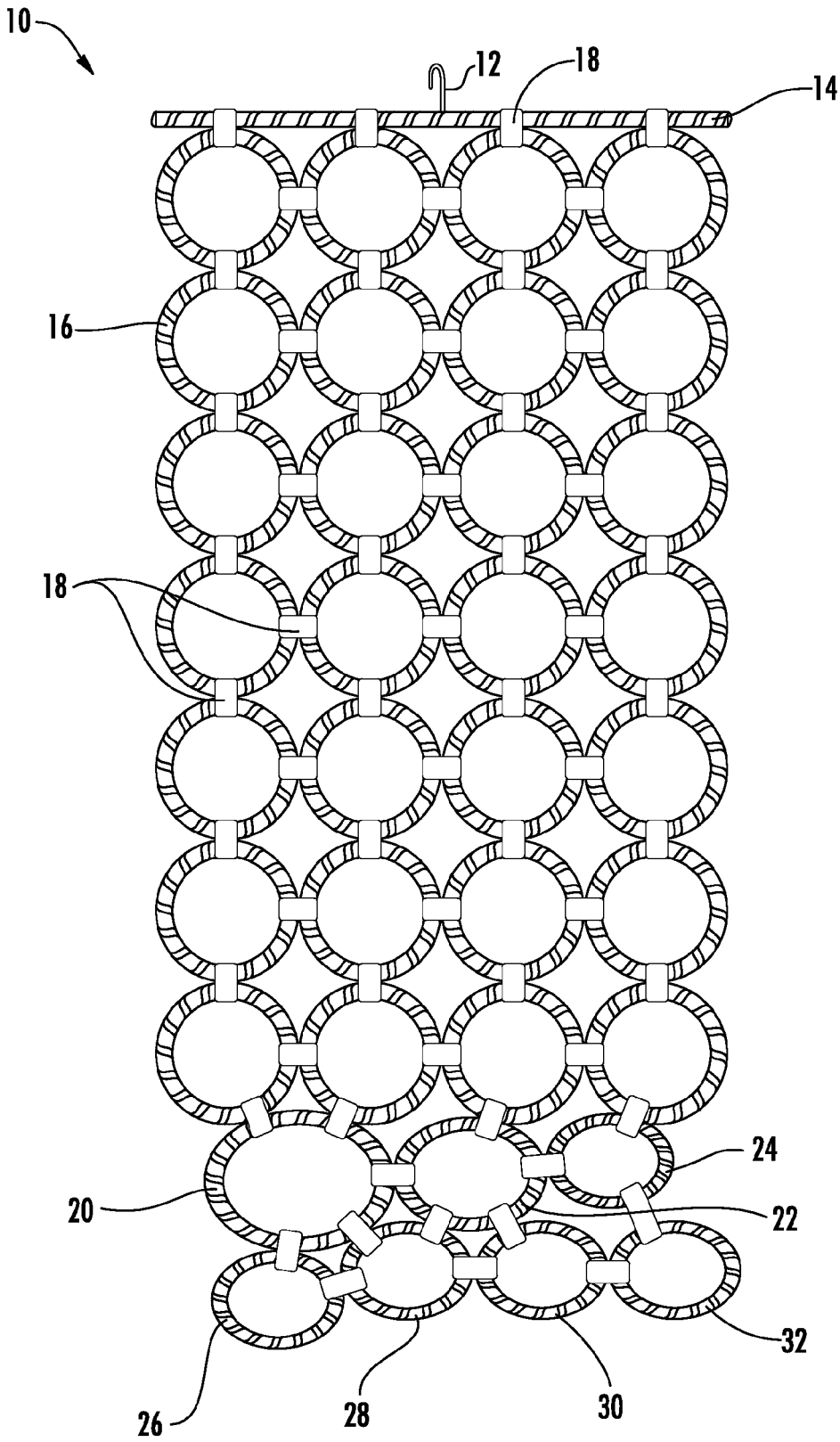
FIG. 2 is a front planar view of the hat storing, displaying, and shaping device of FIG. 1.

Referring now to FIGS. 1 and 2, a cap storing, displaying, and shaping device 10 is shown. The device 10 includes a first series of rings 16. The rings are of substantially the same diameter and are constructed of plastic, wood, metal, or other suitable material. Each of the rings 16 is flexibly connected to at least one other ring 16. The connectivity between rings 16 can be a mesh, series, grid, etc. type pattern as desired by a user. Each ring 16 is configured to receive a cap by the brim of the cap in a suspended manner. Additionally, each ring 16 is configured to maintain the degree of curvature of the brim of the cap.

The device 10 includes a second series of rings 20, 22, 24, 26, 28, 30, 32 that are substantially dissimilar in diameter. The second series of rings 20, 22, 24, 26, 28, 30, 32 are hung in a similar manner as the first series of rings 16, each being flexibly connected to at least one other ring of the second series of rings 20, 22, 24, 26, 28, 30 or the first series of rings 16. Each of the of the second series of rings 20, 22, 24, 26, 28, 30 is configured to receive a cap by the brim of the cap to train the brim of the cap to a predetermined degree of curvature based on which of the second series of rings 20, 22, 24, 26, 28, 30 is selected.

The device 10 also includes a plurality of ring connectors 18. Each ring connector 18 is configured to connect a pair of rings 16 from the first series of rings 16, the second series of rings 20, 22, 24, 26, 28, 30, or a combination of a ring from the first series of rings 16 and the second series of rings 20, 22, 24, 26, 28, 30. The ring connectors 18 are constructed of fabric, cord, plastic, wood, metal, or other suitable material to sufficiently hold ring-shaped items together.

The device 10 also includes a support rod 14, placed atop the cap storage, display, and shaper device 10 in a substantially horizontal manner. The support rod 14 provides a place from which to suspend the first series of rings 16 and provides structural integrity to the cap storage, display, and shaper device 10. The support rod 14 is a plastic, wood, metal or other similar material in a generally cylindrical shape. Ring connectors 18 are also utilized to connect any of the first series of rings 16 to the support rod 14.

The device also includes a hook 12 located in a substantially central manner on top of the support rod 14, and from which the cap storage, display, and shaper device 10 is hung. The hook 14 is fabric, cord, plastic, wood, metal or other similar material suitable for hanging the cap storage, display, and shaper device 10. The device 10 is configured to suspend from a door, wall, ceiling or the like.

The device 10 also includes a plurality of user options in the cap storage, display, and shaper device 10. A user selects a degree of curvature desired for the brim of the cap based on the diameter of one of the second series of rings 20, 22, 24, 26, 28, 30. The user subsequently selects one of the second series of rings 20, 22, 24, 26, 28, 30 into which to place a cap and to suspend by a brim of the cap to train the brim to the degree of curvature desired.

The first series of rings 16 and the second series of rings 20, 22, 24, 26, 28, 30 of the cap storage, display, and shaper device 10 are collapsible, thus configured to provide compactability and portability. Collapsibility is provided along the ring connectors 18, allowing the cap storage, display, and shaper device 10 to be folded to a final width of generally the width of the row containing the largest diameter of rings. The collapsible nature of the cap storage, display, and shaper device 10 greatly increases its portability and ease of use.

The first series of rings 16, the rings of which are substantially similar in diameter, forms a grid of rows and columns to simultaneously store, display, and shape a plurality of caps. A crown portion of each of one or more caps stored in one of the first series of rings 16 or the second series of rings 20, 22, 24, 26, 28, 30 is supported in the suspended manner of the cap, and is thus visible in display for selection. Even under circumstances wherein the cap storage, display, and shaper device 10 is completely full with caps in both the brim maintaining and brim training portions, all crown portions of the caps remain clearly visible, allowing the potential wearer of a cap the ability to quickly and easily located a favorite or desired cap.

Additionally, any ring of the first series of rings 16 and the second series of rings 20, 22, 24, 26, 28, 30 is connected to any other ring of the first series of rings 16 and the second series of rings 20, 22, 24, 26, 28, 30 with a fabric material that is wrapped around the rings to provide connectivity. For example, this is ribbon or macramé, or another suitable material for holding the rings together along one point of the rings.

Each of the first series of rings 16, substantially similar in diameter, is substantially circular to provide a round hole into which to place the brim of the cap. Each of the second series of rings 20, 22, 24, 26, 28, 30, substantially dissimilar in diameter, is ovoid in shape to provide an oval hole into which to place the brim of the cap to train the brim to achieve a desired degree of curvature. An arrangement pattern of the first series of rings 16 and the second series of rings 20, 22, 24, 26, 28, 30 is reconfigurable by the user to determine the overall shape of the cap storage, display, and shaper device 10.

Figure 3:
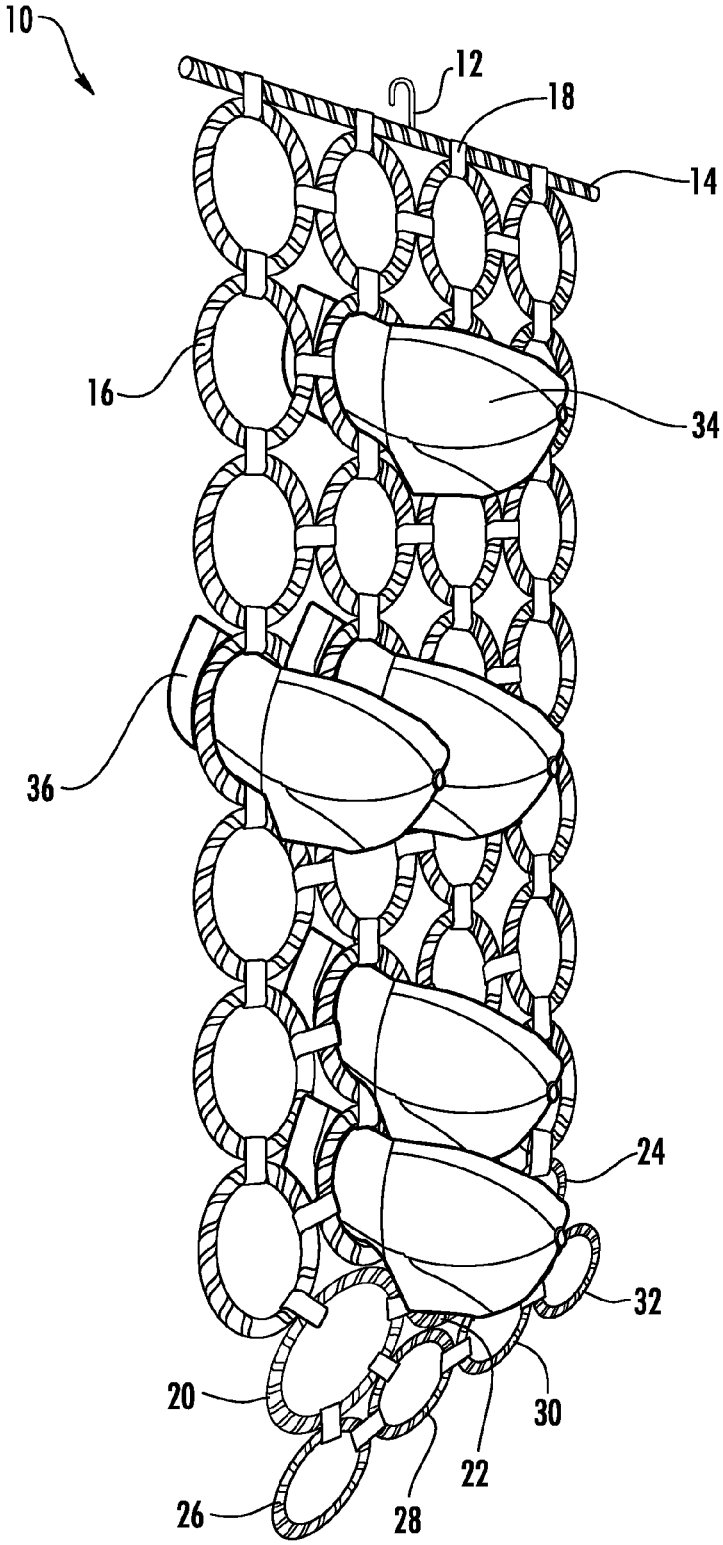
FIG. 3 is a front perspective view of the hat storing, displaying, and shaping device of FIG. 1, further illustrating the device in use holding several hats in place for both storage and display and simultaneously maintaining the brim curvature of the hat.

Referring now to FIG. 3, the cap storing, displaying, and shaping device 10 is shown in use. In addition to the elements shown in FIGS. 1 and 2, multiple caps 34 with brims 36 are shown suspended from the hat storing, displaying, and shaping device 10. The brim 36 of each cap 34 is placed into one of the first series of rings 16 and the second series of rings 20, 22, 24, 26, 28, 30 dependent upon whether the brim 36 is to be trained to a specific curvature or the existing brim curvature is to be maintained. A crown portion of each of one or more caps stored in one of the first series of rings 16 or the second series of rings 20, 22, 24, 26, 28, 30 is supported in the suspended manner of the cap, and is thus visible in display for selection.

Figure 4:
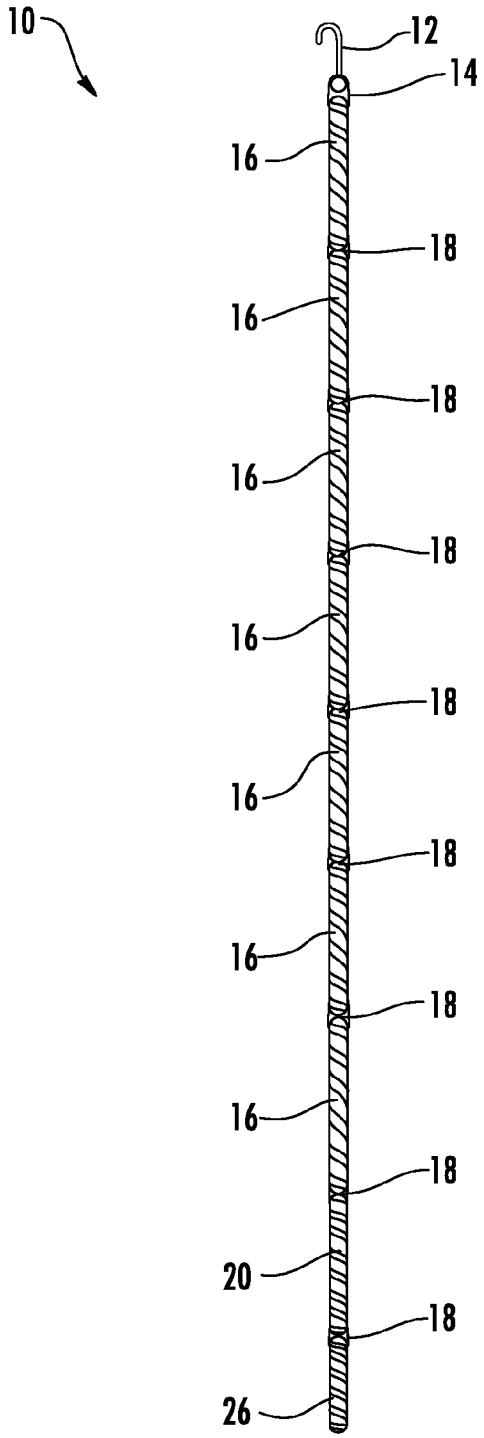
FIG. 4 is a left side planar view of the hat storing, displaying, and shaping device of FIG. 1, further illustrating small depth of the device and thus its ease of use in foldability and portability.

Referring now to FIG. 4, the cap storing, displaying, and shaping device 10 is shown. The cap storing, displaying, and shaping device 10 is shown here from the left side in order to show the depth or thickness of the device 10. This view highlights the flexibility, compactability, and portability of the device due to its minimal depth. Collapsibility is provided along the ring connectors 18, allowing the cap storage, display, and shaper device 10 to be folded to a final width of generally the width of the row containing rings of the largest diameter.

In an alternative embodiment the cap storing, displaying, and shaping device 10 includes a first series of rings 16, substantially similar in diameter and cut into a planar surface, each ring of the first plurality of rings configured to receive a cap 34 by a brim 36 of the cap 34 in a suspended manner and to maintain the degree of curvature of the brim 36 of the cap 34 and a second series of rings 20, 22, 24, 26, 28, 30, substantially dissimilar in diameter and cut into the planar surface. Each ring of the second series of rings 20, 22, 24, 26, 28, 30 is configured to receive a cap 34 by a brim 36 of the cap 34 to train the brim 36 of the cap 34 to a predetermined degree of curvature based on which of the a second series of rings 20, 22, 24, 26, 28, 30 is selected. The planar surface is, in various alternative embodiments, wood, foam, plastic, or any other like durable material for securely holding a multiplicity of hats and maintaining and training the brims of each hat.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. A cap storage, display, and shaper device for simultaneously storing, displaying, and shaping a multiplicity of caps in a manner wherein each cap is suspended by a brim of the cap, the device comprising:

a first plurality of rings, each ring circular in shape and substantially similar in diameter to form a grid of rows and columns to simultaneously store, display, and shape a plurality of caps, and hung in a suspended manner, each of the first plurality of rings being flexibly connected to an at least one other ring of the first plurality of rings and each ring of the first plurality of rings configured to receive a cap by a brim of the cap in a suspended manner and to maintain the degree of curvature of the brim of the cap; and a second plurality of rings, each ring ovoid in shape to provide an oval hole into which to place the brim of the cap to train the brim to achieve a desired degree of curvature and substantially dissimilar in diameter and hung in a suspended manner, each of the second plurality of rings being flexibly connected to an at least one other ring of the second plurality of rings, and an at least one of the second plurality of rings being connected to an at least one of the first plurality of rings, and each ring of the second plurality of rings configured to receive a cap by a brim of the cap to train the brim of the cap to a predetermined degree of curvature based on which of the second plurality of rings is selected.

2. The cap storage, display, and shaper device for simultaneously storing, displaying, and shaping a multiplicity of caps in a manner wherein each cap is suspended by a brim of the cap of claim 1, further comprising:

a plurality of ring connectors, each ring connector configured to connect a pair of rings from the first plurality of rings, the second plurality of rings, or a combination of a ring from the first plurality of rings and a ring from the second plurality of rings.

3. The cap storage, display, and shaper device for simultaneously storing, displaying, and shaping a multiplicity of caps in a manner wherein each cap is suspended by a brim of the cap of claim 1, further comprising:

a support rod, placed atop the cap storage, display, and shaper device in a substantially horizontal manner, from which to suspend the first plurality of rings and the second plurality of rings and to provide structural integrity to the cap storage, display, and shaper device; and a hook, located in a substantially central manner on top of the support rod, and from which the cap storage, display, and shaper device is hung.

4. The cap storage, display, and shaper device for simultaneously storing, displaying, and shaping a multiplicity of caps in a manner wherein each cap is suspended by a brim of the cap of claim 1, wherein the first plurality of rings and the second plurality of rings of the cap storage, display, and shaper device are collapsible, thus configured to provide compactability and portability.

5. The cap storage, display, and shaper device for simultaneously storing, displaying, and shaping a multiplicity of caps in a manner wherein each cap is suspended by a brim of the cap of claim 1, wherein a crown portion of each of a one or more caps stored in one of the first plurality of rings or the second plurality of rings is supported in the suspended manner of the cap, and is thus visible in display for selection.

6. The cap storage, display, and shaper device for simultaneously storing, displaying, and shaping a multiplicity of caps in a manner wherein each cap is suspended by a brim of the cap of claim 1, further comprising:

a plurality of user options in the cap storage, display, and shaper device from wherein a user selects a degree of curvature desired for the brim of the cap based on the diameter of one of the second plurality of rings and wherein the user subsequently selects one of the second plurality of rings into which to place a cap and to suspend by a brim of the cap to train the brim to the degree of curvature desired.

7. The cap storage, display, and shaper device for simultaneously storing, displaying, and shaping a multiplicity of caps in a manner wherein each cap is suspended by a brim of the cap of claim 1, wherein the cap storage, display, and shaper device is configured to suspend from a surface.

8. The cap storage, display, and shaper device for simultaneously storing, displaying, and shaping a multiplicity of caps in a manner wherein each cap is suspended by a brim of the cap of claim 1, wherein any ring of the first plurality of rings and the second plurality of rings is connected to any other ring of the first plurality of rings and the second plurality of rings with a fabric material that is wrapped around the rings to provide connectivity.

9. The cap storage, display, and shaper device for simultaneously storing, displaying, and shaping a multiplicity of caps in a manner wherein each cap is suspended by a brim of the cap of claim 1, wherein each of the first plurality of rings, substantially similar in diameter, is substantially circular to provide a round hole into which to place the brim of the cap.

10. The cap storage, display, and shaper device for simultaneously storing, displaying, and shaping a multiplicity of caps in a manner wherein each cap is suspended by a brim of the cap of claim 1, wherein an arrangement pattern of the first plurality of rings and the second plurality of rings is reconfigurable by the user to determine the overall shape of the cap storage, display, and shaper device.

11. A cap storage, display, and shaper device for simultaneously storing, displaying, and shaping a multiplicity of caps in a manner wherein each cap is suspended by a brim of the cap, the device comprising:

a first plurality of rings, each ring circular in shape and substantially similar in diameter to form a grid of rows and columns to simultaneously store, display, and shape a plurality of caps, and cut into a planar surface, each ring of the first plurality of rings configured to receive a cap by a brim of the cap in a suspended manner and to maintain the degree of curvature of the brim of the cap; and a second plurality of rings, each ring ovoid in shape to provide an oval hole into which to place the brim of the cap to train the brim to achieve a desired degree of curvature and substantially dissimilar in diameter and cut into the planar surface, each ring of the second plurality of rings configured to receive a cap by a brim of the cap to train the brim of the cap to a predetermined degree of curvature based on which of the second plurality of rings is selected.

12. A method for simultaneously storing, displaying, and shaping a multiplicity of caps in a manner wherein each cap is suspended by a brim of the cap, the method comprising:

utilizing a cap storage, display, and shaper device comprising:

a first plurality of rings, each ring circular in shape and substantially similar in diameter to form a grid of rows and columns to simultaneously store, display, and shape a plurality of caps, and hung in a suspended manner, each of the first plurality of rings being flexibly connected to an at least one other ring of the first plurality of rings and each ring of the first plurality of rings configured to receive a cap by a brim of the cap in a suspended manner and to maintain the degree of curvature of the brim of the cap; and a second plurality of rings, each ring ovoid in shape to provide an oval hole into which to place the brim of the cap to train the brim to achieve a desired degree of curvature and substantially dissimilar in diameter and hung in a suspended manner, each of the second plurality of rings being flexibly connected to an at least one other ring of the second plurality of rings, and an at least one of the second plurality of rings being connected to an at least one of the first plurality of rings, and each ring of the second plurality of rings configured to receive a cap by a brim of the cap to train the brim of the cap to a predetermined degree of curvature based on which of the second plurality of rings is selected; and placing a brim of a cap into one of the first plurality of rings, where the cap will remain in a suspended manner while storing and displaying the cap and maintaining the degree of curvature of the brim of the cap is maintained.

13. The method for simultaneously storing, displaying, and shaping a multiplicity of caps in a manner wherein each cap is suspended by a brim of the cap of claim 12, further comprising:

placing a brim of a cap into one of the second plurality of rings, where the cap will remain in a suspended manner while training the brim of the cap.

14. The method for simultaneously storing, displaying, and shaping a multiplicity of caps in a manner wherein each cap is suspended by a brim of the cap of claim 12, further comprising:

utilizing a cap storage, display, and shaper device further comprising:

a plurality of ring connectors, each ring connector configured to connect a pair of rings from the first plurality of rings, the second plurality of rings, or a combination of a ring from the first plurality of rings and a ring from the second plurality of rings; and connecting any of the rings of the cap storage, display, and shaper device together with one or more of the plurality of rings connectors.

15. The method for simultaneously storing, displaying, and shaping a multiplicity of caps in a manner wherein each cap is suspended by a brim of the cap of claim 12, further comprising:

utilizing a cap storage, display, and shaper device further comprising:

a support rod, placed atop the cap storage, display, and shaper device in a substantially horizontal manner, from which to suspend the first plurality of rings and the second plurality of rings and to provide structural integrity to the cap storage, display, and shaper device; and a hook, located in a substantially central manner on top of the support rod, and from which the cap storage, display, and shaper device is hung; and hanging the cap storage, display, and shaper device from the hook such that the first plurality of rings and the second plurality of rings are suspended from the support rod.

16. The method for simultaneously storing, displaying, and shaping a multiplicity of caps in a manner wherein each cap is suspended by a brim of the cap of claim 12, and wherein the first plurality of rings and the second plurality of rings of the cap storage, display, and shaper device are collapsible, thus configured to provide compactability and portability, further comprising:

collapsing the cap storage, display, and shaper device for compactability and portability.

17. The method for simultaneously storing, displaying, and shaping a multiplicity of caps in a manner wherein each cap is suspended by a brim of the cap of claim 12, further comprising:

suspending the cap storage, display, and shaper device from a door.

18. The method for simultaneously storing, displaying, and shaping a multiplicity of caps in a manner wherein each cap is suspended by a brim of the cap of claim 12, further comprising:

suspending the cap storage, display, and shaper device from a wall.

* * * * *